US010920776B2

(12) United States Patent
Hill et al.

(10) Patent No.: US 10,920,776 B2
(45) Date of Patent: Feb. 16, 2021

(54) ROTARY COMPRESSOR AND ASSEMBLY METHOD THEREOF

(71) Applicant: HITACHI-JOHNSON CONTROLS AIR CONDITIONING, INC., Tokyo (JP)

(72) Inventors: Joe Hill, Tokyo (JP); Gene Fields, Wichita, KS (US)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 0 days.

(21) Appl. No.: 16/415,010

(22) Filed: May 17, 2019

(65) Prior Publication Data

US 2019/0271314 A1 Sep. 5, 2019

Related U.S. Application Data

(63) Continuation of application No. PCT/US2017/045890, filed on Aug. 8, 2017.

(51) Int. Cl.

| | |
|---|---|
| ***F03C 2/00*** | (2006.01) |
| ***F03C 4/00*** | (2006.01) |
| ***F04C 11/00*** | (2006.01) |
| ***F04C 2/00*** | (2006.01) |
| ***F04C 23/00*** | (2006.01) |

(Continued)

(52) U.S. Cl.

CPC ..... *F04C 23/001* (2013.01); *F01C 21/02* (2013.01); *F01C 21/10* (2013.01); *F04C 18/356* (2013.01); *F04C 23/008* (2013.01); *F04C 23/02* (2013.01); *F04C 29/068* (2013.01); *F04C 27/00* (2013.01); *F04C 2230/231* (2013.01); *F04C 2230/60* (2013.01); *F04C 2230/603* (2013.01);

(Continued)

(58) Field of Classification Search

CPC ..... F04C 23/001; F04C 23/008; F04C 23/02; F04C 2/00; F04C 18/00; F04C 18/0215; F04C 18/356; F04C 27/00; F04C 29/00; F04C 29/068; F04C 2230/231; F04C 2230/60; F04C 2230/603; F04C 2240/00; F04C 2240/30; F04C 2240/40; F04C 2240/50; F01C 21/02; F01C 21/10

USPC ..... 418/1, 11, 55.1, 60, 63, 249; 417/410.3, 417/902

See application file for complete search history.

(56) References Cited

U.S. PATENT DOCUMENTS

| | | | | |
|---|---|---|---|---|
| 4,992,032 | A | 2/1991 | Barito et al. | |
| 5,037,278 | A * | 8/1991 | Fujio ..... | F04C 18/0215 418/55.2 |

(Continued)

OTHER PUBLICATIONS

International Search Report of PCT/US2017/045890 dated Oct. 19, 2017.

*Primary Examiner* — Theresa Trieu
(74) *Attorney, Agent, or Firm* — Mattingly & Malur, PC

(57) ABSTRACT

A rotary compressor that may include an upper or outboard bearing above the motor components and, in this case, includes an upper bearing plate having a structure that ensures bearing alignment when press fit with an upper cap and a center shell. In some implementations, a main bearing frame that secures and holds a main bearing has a structure that when press fit with a lower cap and center shell ensure bearing alignment. Some implementations include disposing a hermetic terminal and a discharge port a the side of the upper cap or center shell.

18 Claims, 13 Drawing Sheets

(51) Int. Cl.

| | |
|---|---|
| ***F04C 23/02*** | (2006.01) |
| ***F04C 29/06*** | (2006.01) |
| ***F01C 21/10*** | (2006.01) |
| ***F01C 21/02*** | (2006.01) |
| ***F04C 18/356*** | (2006.01) |
| *F04C 27/00* | (2006.01) |

(52) U.S. Cl.
CPC ..... *F04C 2240/30* (2013.01); *F04C 2240/40* (2013.01); *F04C 2240/50* (2013.01)

(56) References Cited

U.S. PATENT DOCUMENTS

| | | | | |
|---|---|---|---|---|
| 5,085,565 | A | 2/1992 | Barito | |
| 5,102,317 | A | 4/1992 | Okoma et al. | |
| 6,056,524 | A | 5/2000 | Williams et al. | |
| 6,074,186 | A | 6/2000 | Lifson et al. | |
| 6,193,484 | B1 | 2/2001 | Hahn et al. | |
| 6,224,059 | B1 | 5/2001 | Sun | |
| 6,247,907 | B1 | 6/2001 | Williams et al. | |
| 6,247,909 | B1 | 6/2001 | Williams et al. | |
| 6,254,365 | B1 * | 7/2001 | Nakanishi | F04B 39/00 417/572 |
| 6,257,851 | B1 | 7/2001 | Bush et al. | |
| 6,261,071 | B1 | 7/2001 | Williams et al. | |
| 6,270,328 | B1 | 8/2001 | Herbert et al. | |
| 6,290,478 | B1 | 9/2001 | Lifson | |
| 6,375,444 | B1 | 4/2002 | Dewar | |
| 6,457,562 | B1 | 10/2002 | Sun | |
| 6,461,130 | B1 | 10/2002 | Sun et al. | |
| 6,464,480 | B2 * | 10/2002 | Fenocchi | F04C 29/028 418/55.6 |
| 6,488,489 | B2 | 12/2002 | Williams et al. | |
| 6,494,688 | B1 | 12/2002 | Barito et al. | |
| 6,554,592 | B1 | 4/2003 | Sun et al. | |
| 6,560,868 | B2 | 5/2003 | Milliff et al. | |
| 6,641,379 | B1 | 11/2003 | Dewar et al. | |
| 6,682,327 | B2 | 1/2004 | Milliff et al. | |
| 6,761,545 | B1 | 7/2004 | Witham et al. | |
| 6,821,092 | B1 * | 11/2004 | Gehret | F04B 1/06 417/213 |
| 6,969,243 | B1 | 11/2005 | Lifson et al. | |
| 7,043,817 | B2 | 5/2006 | Powell et al. | |
| 7,063,522 | B1 | 6/2006 | Sun | |
| 7,273,362 | B2 | 9/2007 | Patel et al. | |
| 7,377,755 | B2 * | 5/2008 | Cho | F04C 23/008 417/310 |
| 7,641,456 | B2 | 1/2010 | Hahn | |
| 2011/0165000 | A1 | 7/2011 | Kobayashi | |
| 2012/0174620 | A1 | 7/2012 | Takashima et al. | |
| 2013/0219952 | A1 | 8/2013 | Takashima et al. | |
| 2015/0078933 | A1 | 3/2015 | Takashima et al. | |

* cited by examiner

ROTARY COMPRESSOR AND ASSEMBLY METHOD THEREOF

CROSS-REFERENCE TO RELATED APPLICATION

This application is a continuation application of PCT/US2017/045890, filed on Aug. 8, 2017, the entire contents of which are hereby incorporated by reference.

BACKGROUND

Rotary compressors typically include one or more rotary compression units or assemblies, suction ports for introducing fluid to be compressed into the compression units, a discharge port, a main bearing, and motor components (e.g., motor and stator) for driving a main shaft. The motor components may be disposed on an opposite side of the main bearing than the compression units in the axial direction. According to some arrangements, the main bearing assembly may include the only bearing (typically two bearing inserts) and is therefore long in the axial direction to support the main shaft. Additionally, some implementations may include a bearing assembly (e.g., lower bearing) on an opposite side of the compression units than the main bearing for additional support of the main shaft.

In general, compressors may be high side or low side compressors which generally refers to the pressure of the fluid inside the compressor housing itself. For example, rotary compressors are typically high side compressors, meaning most of the pressure inside the housing of the compressor is at a discharge pressure, which is greater than the suction pressure. Scroll compressors, for example, may be high side or low side. Low side meaning that most of the pressure inside of the compressor is at the suction pressure rather than the discharge pressure.

In some compressors, such as in low side scroll compressors, one or more MIG (metal inert gas) plugs (or other welding technique) may be welded into one or more holes in the center shell (case) at or near the support member (e.g., main frame). However, there are drawbacks to this technique when applied to a high side compressor since the discharge pressure is much greater than the suction pressure. In the high side compressors, the center shell expands in the radial direction from the higher (discharge) pressure and from thermal expansion thereby enlarging a clearance between the support member and the center shell in the radial direction. This results in an undesirable effect of excess noise or sound during operation of the compressor and can lower the operational efficiency of the compressor. The presently claimed invention eliminates or makes obsolete the MIG welds at the pre-drilled holes in the center shell discussed above. Additionally, the plug MIG welds described above that fasten the bearing and compression parts to the center shell are not as reliable as compared to when components are press fit according to the assembly technology disclosed herein. One advantage of the configuration and techniques disclosed herein is that the sound level during operation and sound quality is much better. The press fit for rotary compressor is a superior holding force as compared to using MIG welds, for example, especially considering the rapid compression that causes higher torque pulsations that occur in rotary compressors and as a result of rotary compressors being high side compressors.

Commercial application of rotary compressors demand more cooling/heating capacity (HP/kw/btu). One way to increase capacity is to increase the number of compression units, which are typically disposed below the main bearing in the axial direction. However, upon increasing the number of compression units, the motor (stator and rotor), height, main shaft length must also increase in the axial direction. This causes instability problems since the main shaft length the main bearing cannot adequately handle the compression and magnetic forces acting on the main shaft. Therefore the top end of the main shaft may be displaced in the radial direction upon rotation and may suffer a "wobble" effect. This has the effect of reducing overall efficiency, among other problems. One solution may be to include an outboard bearing (i.e., a bearing above the motor in the axial direction). However, the alignment of each of the bearings (e.g., main bearing, lower bearing, and upper bearing [outboard bearing]) on the main shaft is difficult to achieve in a reasonable manner that does not unreasonably inhibit the assembly processes and techniques.

Further, during operation, there is a strong magnetic force produced between the stator and the rotor of the motor and this creates the rotating motion of the main shaft. In addition to the rotation, this magnetic force also creates a very strong attraction force between the parts. The space between the rotor and the stator is a clearance, and is commonly called an "air gap." In configurations which do not include an upper bearing a cantilever force is present and the air gap can become reduced on one side as the shaft rotates the compression mechanisms. This is magnetic distortion. This is one reason that some configurations and techniques require a design that has a larger air gap than is optimal. In addition, maintaining a minimum air gap around the space between the rotor and the stator requires difficult manufacturing and assembly steps. Air gap control is a significant drawback with a cantilever shaft bearing design, and these factors require a larger clearance than would be required if the shaft had an aligned upper bearing. Further, a smaller air gap results in a greater motor operating efficiency.

SUMMARY

Some implementations include rotary compressor configurations and techniques for aligning at least one of lower bearings, main bearings, and an upper bearing on a main shaft. For instance, an upper bearing may be disposed above the motor and one or more compression units may be disposed below the main bearing on the main shaft. An upper bearing plate may be disposed to secure and contain the upper bearing and a main bearing frame may be disposed to secure and contain the main bearing. A center shell may be provided, along with an upper cap and a lower cap, as components of the housing or main body of the compressor. In some instances, assembly by press fit of these housing elements along with the upper bearing plate and main bearing frame result in alignment of two or more bearings on the main shaft. In some instances a lower bearing, which is disposed below the compression units in the axial direction and lower bearing plate securing and housing the lower bearing are unnecessary for stability of the main shaft since the upper bearing and upper bearing plate in addition to the main bearing and main bearing frame provide adequate stability of the forces acting on the main shaft produced by compression, magnetics (e.g., of the motor), the main bearing, and the upper bearing above the motor, for example.

BRIEF DESCRIPTION OF THE DRAWINGS

The detailed description is set forth with reference to the accompanying figures. The use of the same reference numbers in different figures indicates similar or identical items or features.

DETAILED DESCRIPTION

The technology disclosed herein includes novel configurations and arrangements and techniques for press fit assembly of rotary compressors that include one or more rotary compression units or assemblies. For example, the technology increases efficiency of the compressor itself even at high operation speeds and reduces the noise associated with operation of the compressor. Further, the configuration and techniques described herein result in superior assembly and manufacturing techniques since bearing alignment is achieved and secured due to the structure (i.e., shape) of the elements (e.g., upper cap, center shell, lower cap, upper bearing plate, and main bearing frame), configuration of the elements (i.e., positional relationships), and assembly of the elements by press fit, as disclosed herein. Additionally, press fit may refer to using force to press components together. The present invention aligns and secures the bearing and compression components to the housing, motor, and running gear.

Figure 1:
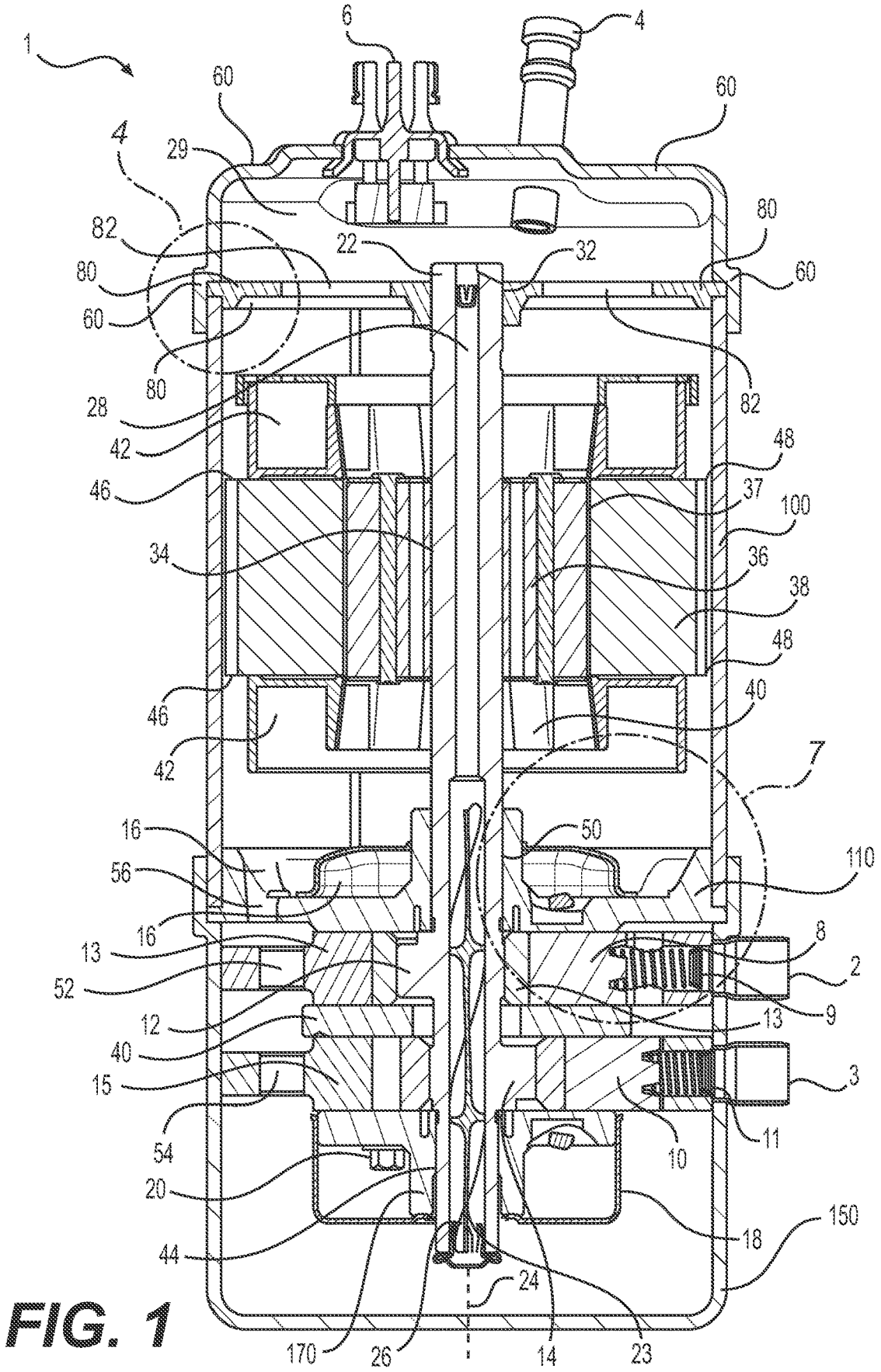
FIG. 1 illustrates a cross-sectional view of a rotary compressor according to some implementations.

Those having ordinary skill in the art recognize that there are different types of compressors. Different types of compressors (e.g., scroll and rotary) may have different advantages and drawbacks depending on their application. FIG. 1 illustrates a cross-sectional view of a rotary compressor according to some implementations.

Figure 8:
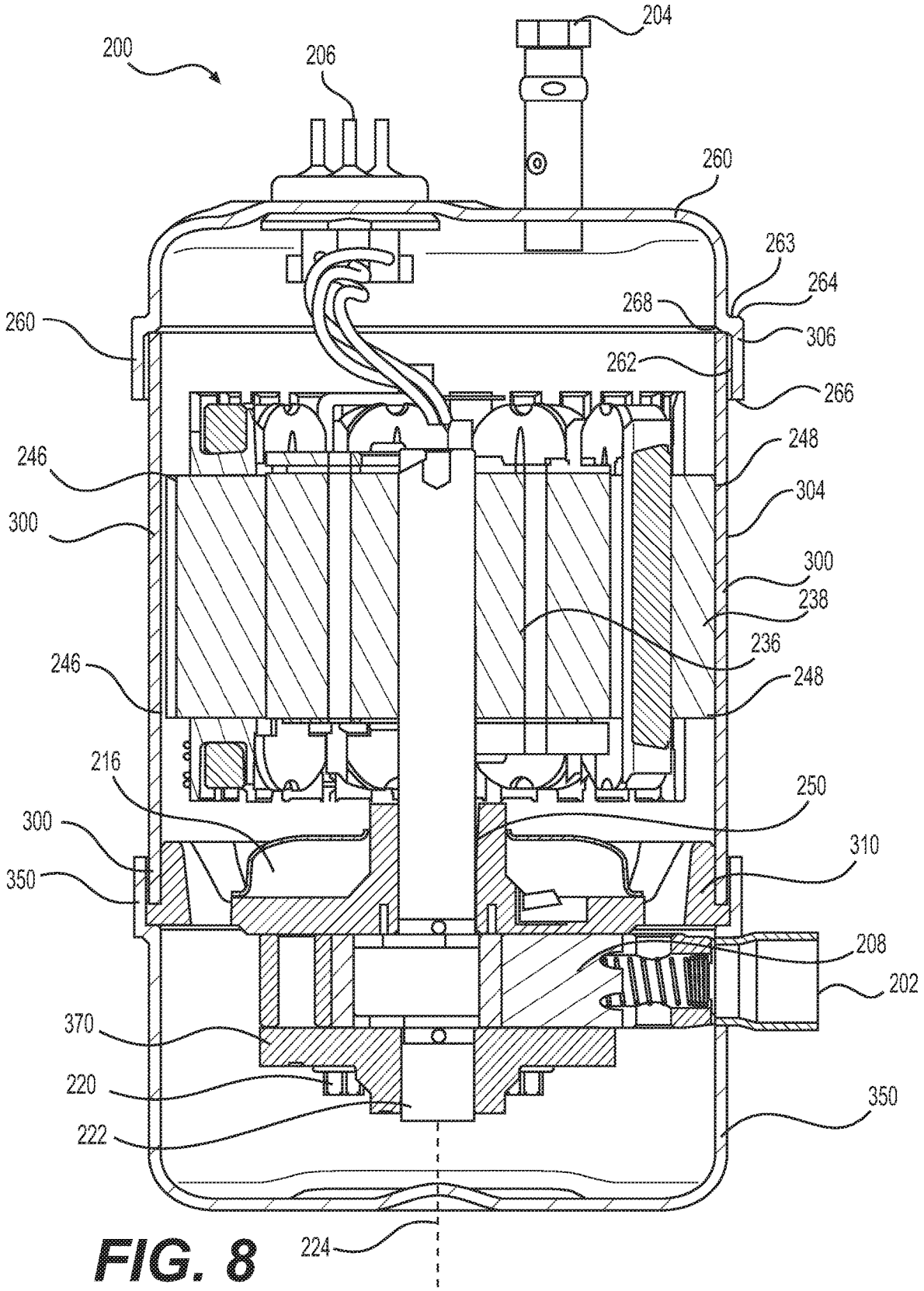
FIG. 8 illustrates a cross-sectional of a rotary compressor according to some implementations.

FIG. 1 shows a twin rotary compressor having an upper rotary compression unit and a lower rotary compression unit which are in the lower portion of the housing disposed below a main bearing 50 and above a lower bearing 44. In this instance, the housing may include an upper cap 60, center shell 100, and lower cap 150. Although FIG. 1 shows a twin rotary compressor having two compression units, the number of compression units is not limiting. For example, some implementations of the compressor could include more compression units or a single compression unit (as shown in FIG. 8, for example). As the number of compression units within one compressor 1 increases the length of the main drive shaft 22 may also increase in the axial direction. In these cases, an upper bearing or outboard bearing 32 may be implemented to ensure alignment of the bearings (e.g., upper bearing 32, main bearing, 50, and lower bearing 44) and prevent displacement of the main drive shaft 22. Further, some implementations of the compressor may not include a lower bearing 44 and assembly.

In general the rotary compressor 1 of FIG. 1 shows a compressor having an upper suction port 2 for an upper compression unit, having a vane 8 and a spring 9, upper cylinder 13 and a lower suction port 3 for a lower compression unit, having a vane 10 and a spring 11, and lower cylinder 15. For ease of description the compression components that compress the fluid introduced into the respective suction ports may be referred to as "compression units." As is known, refrigerant gas is suctioned into the suction ports at a suction pressure and compressed by the compression unit(s) and discharged at a discharge port 4 at a discharge pressure 29. As is typical with high side compressors most of the housing of the compressor is at a discharge pressure 29 during operation. A main drive shaft 22 extends along an axial direction and along a main axis 24 of the rotary compressor 1. In this implementation, three bearings including a lower bearing 44, a main bearing 50, and an upper bearing 32, although the number of bearings is not limiting. The main drive shaft 22 extends in the axial direction through the bores of each of the lower bearing 44, main bearing 50, and upper bearing 32, which support and maintain alignment of the main drive shaft 22. The main drive shaft 22 is driven by a stator 38 through rotor 36. Windings 42 of the motor may be above the main bearing 50 and below the upper bearing 32 in the axial direction. An air gap or clearance 37 is disposed between the stator 38 and the rotor 36.

A hermetic terminal 6 may be disposed in a top surface of the upper cap 60, although the position of the hermetic terminal 6 is not limiting. Further, the hermetic terminal 6 may have three leads. The main drive shaft 22 is operably connected to cause movement of the upper eccentric 12 and lower eccentric 14 of the respective rotary compression units. As the main drive shaft 22 is driven, oil is pumped up and through oil pump components 26, which may include a sheet metal baffle and the like. Oil may flow through an oil bore 28 of the main drive shaft 22, which may be slanted, by driving of the main drive shaft 22 and oil may be forced upward through centrifugal forces, for example.

An intermediate plate 40 may be disposed between the twin rotary compression units. The intermediate plate 40 serves as an upper surface of the lower compression unit, and may serve as a lower surface of the upper compression unit. Upper discharge muffler 16, which may consist of sheet metal, may be disposed above the main bearing frame 110 and may contact a top surface of the main bearing frame 110. Further, one or more fasteners 20, such as rivets or bolts, may securely fasten the upper discharge muffler 16, main bearing plate 110, twin compression units, intermediate plate 40, and lower bearing plate 170. The fasteners 20 may be disposed in the axial direction.

The upper cap 60, center shell 100, and lower cap 150 have generally circular profiles. The lower cap 150 may essentially be bowl-shaped having vertical extending edges or rims that are essentially parallel to the main axis 24. The lower cap 150 has an open end or face into which components of the compressor are assembled or disposed. The center shell 100 is essentially a cylinder having an axis parallel to the main axis 24 and concentric to the bore(s) of the one or more bearings on the main shaft 22. The center shell 100 has open top and bottom ends and may be referred to as a "case." The upper cap 60 may essentially be a bowl-shaped having vertical edges or rims that are essentially parallel to the main axis 24. The upper cap 60 has an open end or face which houses components of the compressor once pressed in place during assembly. The shape and structure of the edges of the upper cap 60, center shell 100, and lower cap 150 will be explained in more detail below. The center shell may be sheet metal or steel tubing or the like. The upper cap 60, center shell 100, and lower cap may be made of low carbon steel. The main bearing frame 110 may be cast iron and the upper bearing plate 80 may be cast iron, die cast aluminum, or low carbon steel.

As shown in FIG. 1, the lower bearing 44 and lower bearing plate 170 are disposed below the twin compression units in the axial direction. In some implementations the rotary compressor, whether single rotary, twin rotary, or otherwise may include a lower bearing plate 170 that houses and secures a lower bearing 44. The lower bearing plate 170 may be disposed below the compressor elements (e.g., 10) in the axial direction. In this instance, the main shaft 22 may extend lower than the lower bearing plate 170, as shown.

The main drive shaft 22 may extend below the lower bearing plate 170 or may be flush or even with the lower bearing plate 170 in the axial direction, and these variations may be related to the intake of oil into the centrifugal pump 28. The main bearing frame 110 may be disposed above the twin compression units, and below the motor components, which may consist of the rotor 36 and stator windings 38, 42 in the axial direction. Therefore, according to some implementations, the upper bearing 32 and an upper bearing plate 80 are disposed near the opposite end of the main drive shaft 22, rather than the lower bearing 44 or main bearing 50 and above the motor components, which may include the rotor 36 and stator 38. This upper bearing 32 may be referred to as an outboard bearing, meaning above the motor components, as shown in FIG. 1.

Additionally, as described below in more detail, the structure and physical relationships of the upper cap 60, upper bearing plate 80, center shell 100, main bearing plate 110, and lower cap 150 permit alignment of the upper bearing 32, main bearing 50, and lower bearing 44. In some implementations, as the lower cap 150, main bearing plate 110, center shell 100, upper bearing plate 80, and upper cap 60 are press fit together during assembly, the bearings self-align due to the shape and structure of the above mentioned components. Upon assembly, the axes of the upper bearing 32, upper bearing plate 80, main bearing 50, main bearing frame 110, lower bearing 44, and lower bearing plate 170 are parallel and concentric with the main axis 24.

Figure 2:
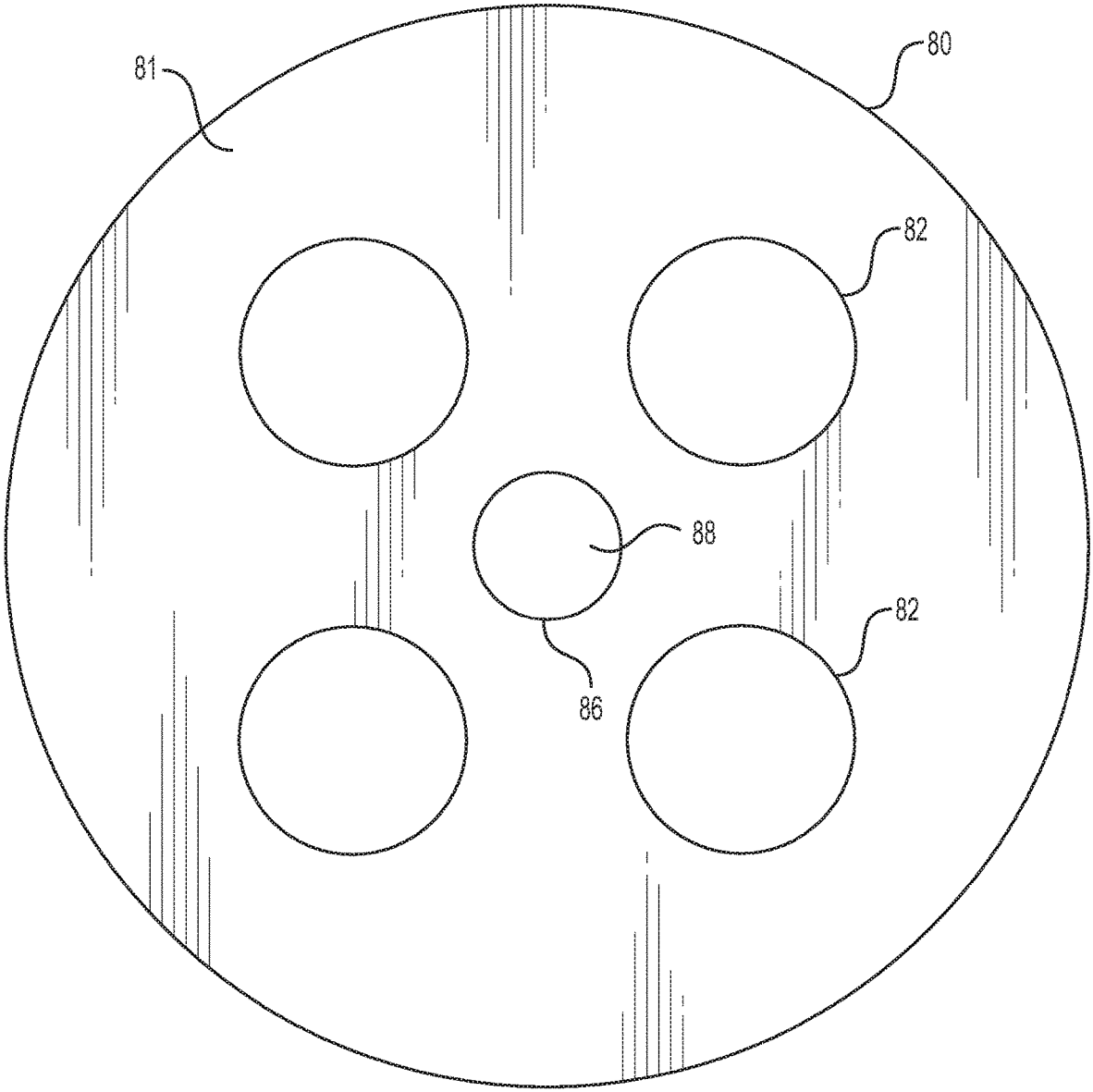
FIG. 2 illustrates a top view of an upper bearing plate of a rotary compressor according to some implementations.

FIG. 2 illustrates a top view of an upper bearing plate 80 of a rotary compressor according to some implementations. As shown, the upper bearing plate 80 has a circular profile and may include one or more openings 82, which may be of circular shape. The openings may be a gas and oil passage allowing oil to pass through the upper bearing plate. The upper bearing plate 80 has a bore 88 for housing or containing the upper bearing 32 and the inner peripheral surface 86 of the bore 88 contacts and abuts the upper bearing 32. The bore 88 is concentric with the main axis 24 and the upper bearing 32. An outer diameter 84 of the upper bearing plate 80 contacts an inner surface 62 of the upper cap 60, which is explained in more detail below. In some implementations, there may be a radial clearance or gap between the outer diameter 84 and a portion of an inner surface 62 of the upper cap 60.

Figure 3:
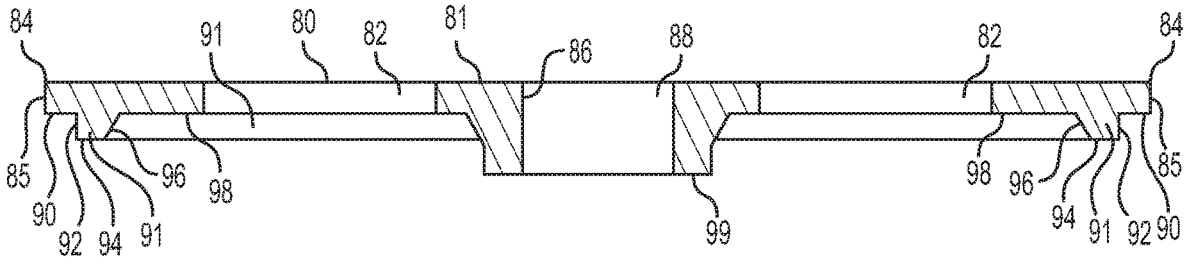
FIG. 3 illustrates a cross-sectional view of the upper bearing plate of FIG. 2 according to some implementations.

FIG. 3 illustrates a cross-sectional view of the upper bearing plate of FIG. 2 according to some implementations. As shown in FIGS. 2 and 3 upper bearing plate 80 has a top surface 81 that is planar, may be flat, and smooth according to some implementations. The top surface 81 extends to an outer diameter 84 and is perpendicular to the main axis 24. Additionally, the top surface 81 may contact portions of inner surfaces 62 of the upper cap 60 at one or more contact points, which is explained in more detail below.

Extending downward in the axial direction from the top surface 81 around the outer diameter 84 of the upper bearing plate 80 is an outer vertical edge 85. The outer vertical edge 85 may be machined to be flat and smooth and is parallel to the main axis 24, perpendicular to the top surface 81, and concentric to the bore of the upper bearing 32. The outer vertical edge 85 faces outward and, as explained in more detail below, may contact portions of an inner surface of the upper cap 60 at various contact points.

As shown in FIG. 3, perpendicular to the outer vertical edge 85 and extending inward in the radial direction is a bottom facing surface 90 that faces downward in the axial direction. The bottom facing surface 90 may be parallel to the top surface 81 and may be perpendicular to the main axis 24. As will be explained in more detail below, the bottom facing surface 90 contacts a top edge 106 of the center shell or case 100. Further, the diameter of the bottom facing surface 90 may be equal to a width or thickness of the center shell 100 in the radial direction so that upon assembly the outer surface 104 of the center shell 100 and the outer vertical edge 85 are flush or even in the radial direction. The diameter of the bottom facing surface 90 may be even around the upper bearing plate 80 and the bottom facing surface 90 may be machined to be flat and may be smooth.

Extending downward in the axial direction from the bottom facing surface 90 is an inward vertical edge 92 that is perpendicular to the bottom facing surface 90 and concentric to the main axis 24. The inward vertical edge 92 may be machined to be flat and smooth and faces outward. As explained in more detail below, the inward vertical edge 92 contacts a portion of the inner surface 102 of the center shell 100 at multiple contact points. The diameter of the outward face of the inward vertical edge 92 is less than that of the outer diameter 84. In other words, the inward vertical edge 92 does not extend in the radial direction as far as the outer diameter 84 and is offset from the outer diameter 84 by a radial distance (diameter) of the bottom facing surface 90.

Radially inward from the inward vertical edge 92 and perpendicular to the inward vertical edge 92 is a lower bottom facing surface 94. The lower bottom facing surface 94 faces downward and may be parallel to top surface 81 and perpendicular to main axis 24. The lower bottom facing surface 94 may also be machined to be smooth and flat around the upper bearing plate 80.

In some implementations, an oblique surface 96 extends upward and inward relative to the lower bottom facing surface 94 to the bottom surface 98 of the upper bearing plate 80. The oblique surface 96 is oblique with respect to the lower bottom facing surface 94 and the bottom surface 98. Surface 96 is shown as oblique, but this not limiting and surface 96 may also be square or perpendicular with respect to the lower bottom facing surface 94. Bottom surface 98 of upper bearing plate 80 may be in the same horizontal plane or a different one than bottom facing surface 90.

In another example, the structure formed by the inward vertical edge 92, lower bottom facing surface 94 and the oblique surface 96 may be a protrusion or flange 91 protruding downward in the axial direction away from a bottom surface 98, which is opposite the top surface 81 of the upper bearing plate 80. The protrusion 91 may be formed as a contiguous member around the circumference of the upper bearing plate 80 and outside of one or more openings 82 in the radial direction. In some examples, the protrusion 91 may be formed in sections around the circumference of the upper bearing plate 80 at respective contact points of the center shell 100. In the axial direction, the lower bottom facing surface 94 may be higher than the bottom surface 99 of the upper bearing bore 88.

Figure 4:
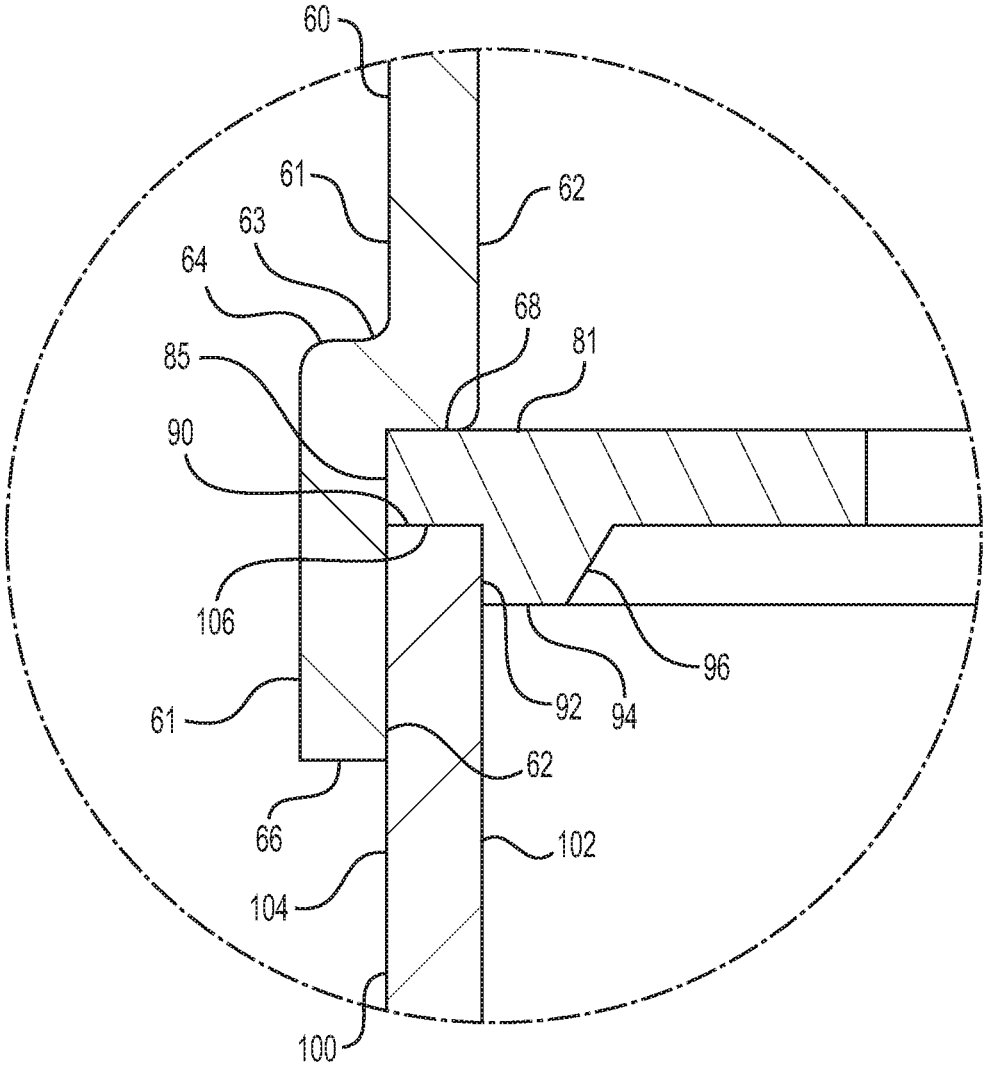
FIG. 4 illustrates an enlarged sectional view of a portion of the cross sectional view of the rotary compressor of FIG. 1 according to some implementations.

FIG. 4 illustrates an enlarged sectional view of a portion of the cross-sectional view of the rotary compressor of FIG. 1 according to some implementations. As explained in more detail below, upon assembly, the upper cap 60 is press fit onto the upper bearing plate 80 and the center shell 100. As further explained in more detail below, upper cap 60 has a stepped portion or shoulder portion 63 extending in the radial direction forming a surface 64, which may be horizontal, upon which a force may applied to press fit the relevant components. The machined end or rim of upper cap 60 extends in the axial direction off of the shoulder portion 63 and the end surface 66 of the rim is essentially flat and perpendicular to the main axis 24. The upper cap 60 may be a sheet metal edge from a stamping operation. Further, this may be the surface for one or more MIG welds to the center shell. Upper cap 60 generally has a thickness or width defined by a radial dimension of the outer surface 61 and a radial dimension of the inner surface 62. The thickness of the upper cap 60 may be uniform or may vary.

An inner downward facing surface 68 may be square (perpendicular) to the inner surface 62 and may extend outward in the radial direction, as shown in FIG. 4. The inner downward facing surface 68 contacts or abuts the upper surface 81 of the upper bearing plate 80. As shown, both the inner surface 62 and the outer surface 61 further extend downward in the axial direction from the step or shoulder portion 63. In other words, the end or rim 66 of the upper cap 60 extends downward and the end surface 66 overlaps a portion of the center shell 100 below the upper baring plate 80. The exposed surface 66 or ultimate end of the rim of the upper cap 60 may extend further down in the axial direction toward the lower cap 150 depending on the position of various welds that may be placed to hold the alignment of respective elements especially the bearing components. The inner surface 62 of the upper cap 60 may contact the outer vertical edge 85 of the upper bearing plate 80 and may contact the outer surface 104 of the center shell 100. In some examples a gap or clearance may exist between the inner surface 62 and the upper bearing plate 80 and the outer surface 104 of the center shell. In addition, the outer radial surface 104 of the center shell and the outer vertical edge 85 may be flush or aligned in the radial direction. Alignment may only depend on the contact of top edge 106 and bottom facing surface 90, and inward vertical edge 92 and inner surface 102.

As further shown in FIG. 4, the upper end or top of the center shell 106 abuts or contacts the bottom facing surface 90. Since these two surfaces (i.e., upper end 106 and bottom facing surface 90) are flat and may be smooth and are parallel to one another and perpendicular to main axis 24 alignment of the upper bearing 32 may be achieved.

As mentioned above, the center shell 100 may essentially be a hollow cylinder having top end 106 and lower end 108. The top end 106 and lower end 108 are machined so as to have flat surfaces that are parallel within one another, in horizontal planes, and are perpendicular (i.e., square) to the main axis 24. Further, the axis of center shell 100 is concentric to the main axis 24. The top end 106 and lower end 108 may be machined by spin rotation and both ends may be machined at the same time. Other machining techniques may be used so long as the ends are parallel with each other and perpendicular to the main axis 24. These elements assist in achieving and maintaining alignment of the upper bearing 32, main bearing 50, and lower bearing 44 on the main shaft 22 upon assembly.

Figure 5:
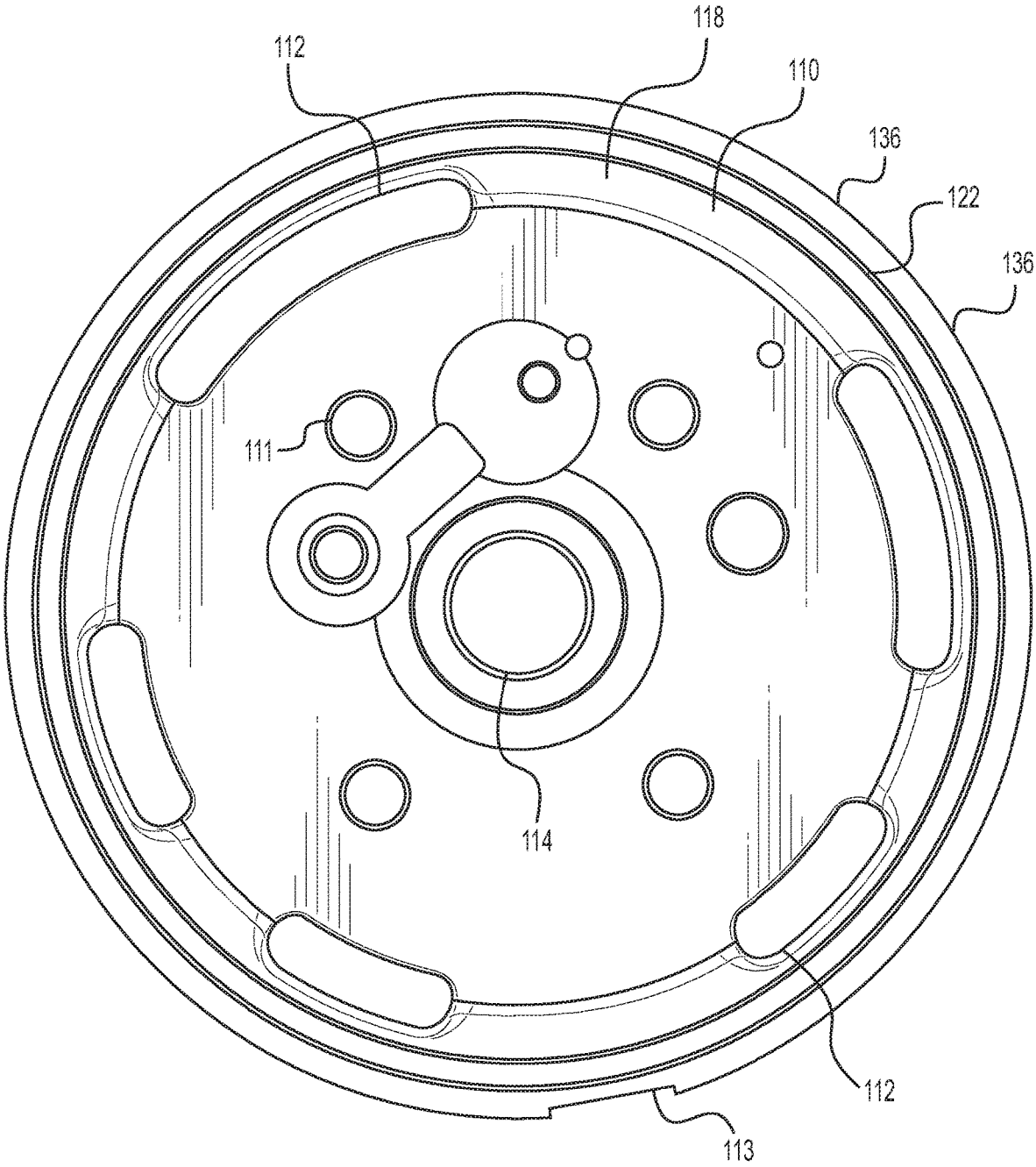
FIG. 5 illustrates a top view of a main bearing frame of a rotary compressor according to some implementations.

FIG. 5 illustrates a top view of a main bearing frame of a rotary compressor according to some implementations. Main bearing frame 110 is a component that that further ensures and maintains bearing alignment on the main shaft 22. The main bearing frame 110 generally has a circular profile with elements having different diameters, as will be explained in further detail below. The top view of FIG. 5 shows one or more openings or passages 112 which may be periodically spaced apart around the main bearing frame 110 and, for example, allow oil to pass downward to lower cap 150 and discharge gas upward to discharge fitting 4. One or more openings or passages 111 may also be spaced apart periodically around the main bearing frame 110 and these accommodate the plurality of bolts 20, which secure the compression units together. An outer diameter 136 may contact portions of both the lower cap 150, and the center shell 100 which will be explained in more detail below. In some implementations, there may be a radial clearance or gap between the outer diameter 136 and the lower cap 150.

A notch or cutout 113 may also be provided in the outer diameter 136. As will be explained in more detail below, the center shell 100 starts as a flat piece, is then rolled into a cylinder, then clamped in a round next such that the ends come together, as a vertical seam in the cylinder shape. Then the seam is welded together, the center shell 100 is then expanded to be round within a tolerance. However, the seam weld produces an intrusion on the inside as well as outside. The notch 113 is to avoid contact with the intrusion, or it would affect the true position axis 24.

The main bearing frame 110 further includes a bore 114 for housing or containing the main bearing 50 (which may be two bearing inserts) and is concentric to the main axis 24 and main bearing 50. Upon assembly the inner peripheral surface 116 of the bore 114 contacts or abuts the main bearing 50.

Figure 6:
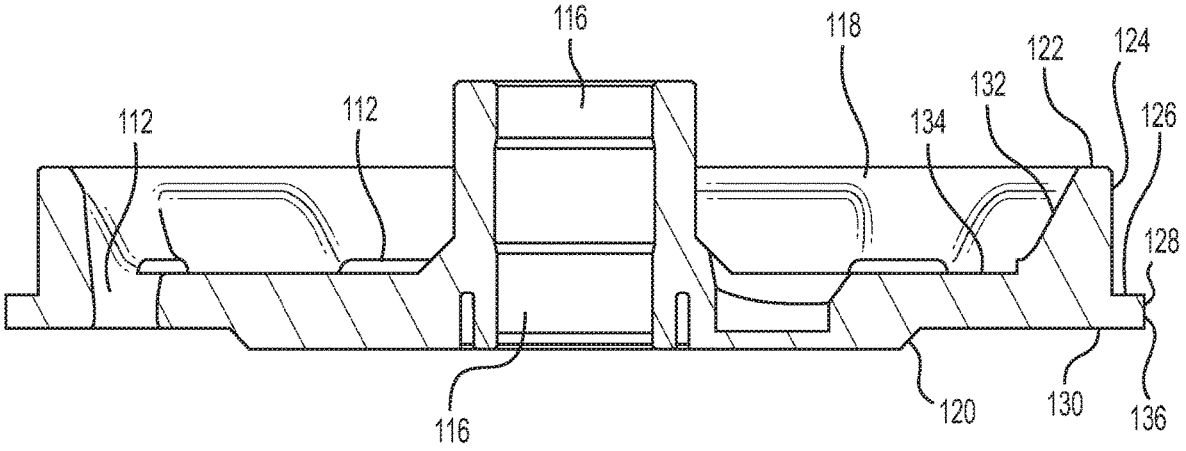
FIG. 6 illustrates a cross-sectional view of the main bearing frame of FIG. 5 according to some implementations.

FIG. 6 illustrates a cross-sectional view of the main bearing frame of FIG. 5 according to some implementations. As shown, main bearing frame 110 has a main outer diameter 136 and around the circumference of the main outer diameter 136 a flat outer vertical edge 128 is machined. The outer vertical edge 128 is parallel to the main axis 24 and concentric to the bore of the main bearing 50. The lower side of the outer vertical edge 128 intersects and is perpendicular with a stepped bottom surface 130. Stepped bottom surface 130 extends in the radial direction from a bottom surface 120, that is closer to the main bearing 50 than the stepped bottom surface 130 in the radial direction. In addition, the stepped bottom surface 130 may be in a different horizontal plane than the bottom surface 120. Bottom surface 120 extends from a bottom of the main bearing bore of the main bearing frame 110. Bottom surface 120 is perpendicular to the bore 114 and main axis 24 and aligns the cylinder face of the compression unit and it is bolted to this surface. Stepped bottom surface 130 sits in the offset in lower cap 150 and a portion of stepped bottom surface 130 contacts a top facing surface 160 of the lower cap 150.

At the upper end of the outer vertical edge 128 a top facing surface 126 extends inward in the radial direction and is generally a flat surface. The outer vertical edge 128 and the top facing surface 126 are perpendicular to one another and the top facing surface 126 is perpendicular to the main axis 24. An inward vertical edge 124 may be machined and faces outward and extends in the axial direction from the top facing surface 126 and is perpendicular to the top facing surface 126. The diameter of the inward vertical edge 124 is less than that of the outer diameter 136 and the inward vertical edge 124 is above the outer vertical edge 128 in the axial direction.

Intersecting the inward vertical edge 124 is a top rim surface 122 that faces upward which forms a rim-like member above the top facing surface 126 in the axial direction. The top rim surface 122 and the inward vertical edge 124 are perpendicular to each other and their intersection may be squared to form a corner or may be rounded, etc. Tapering downward in the axial direction and inward in the radial direction is the top surface 132 of an inner bowl or cup-shaped portion 118 of the main bearing frame 110 that has a bottom surface 134, which may be elevated with respect to the top facing surface 126 in the axial direction. The inner-facing surface 132 may be curved, tapered, and may be smooth and slopes inward from the top rim surface 122 toward the bearing bore 114 to form the inner bowl or cup-shaped portion 118. The bottom surface 134 of the cup or bowl-like portion 118 is essentially a top surface of the main bearing frame 110. The tapered surface 132 forms a wall or protrusion around the main bearing frame 110 that has a thickness in the radial direction that may be greater than a radial dimension of the top facing surface 126. In addition, the top facing surface 126 and the surface 134 may be in different horizontal planes. In some implementations, the inner facing surface 132 may be parallel to the main axis 24 and therefore perpendicular to top facing surface 122.

Figure 7:
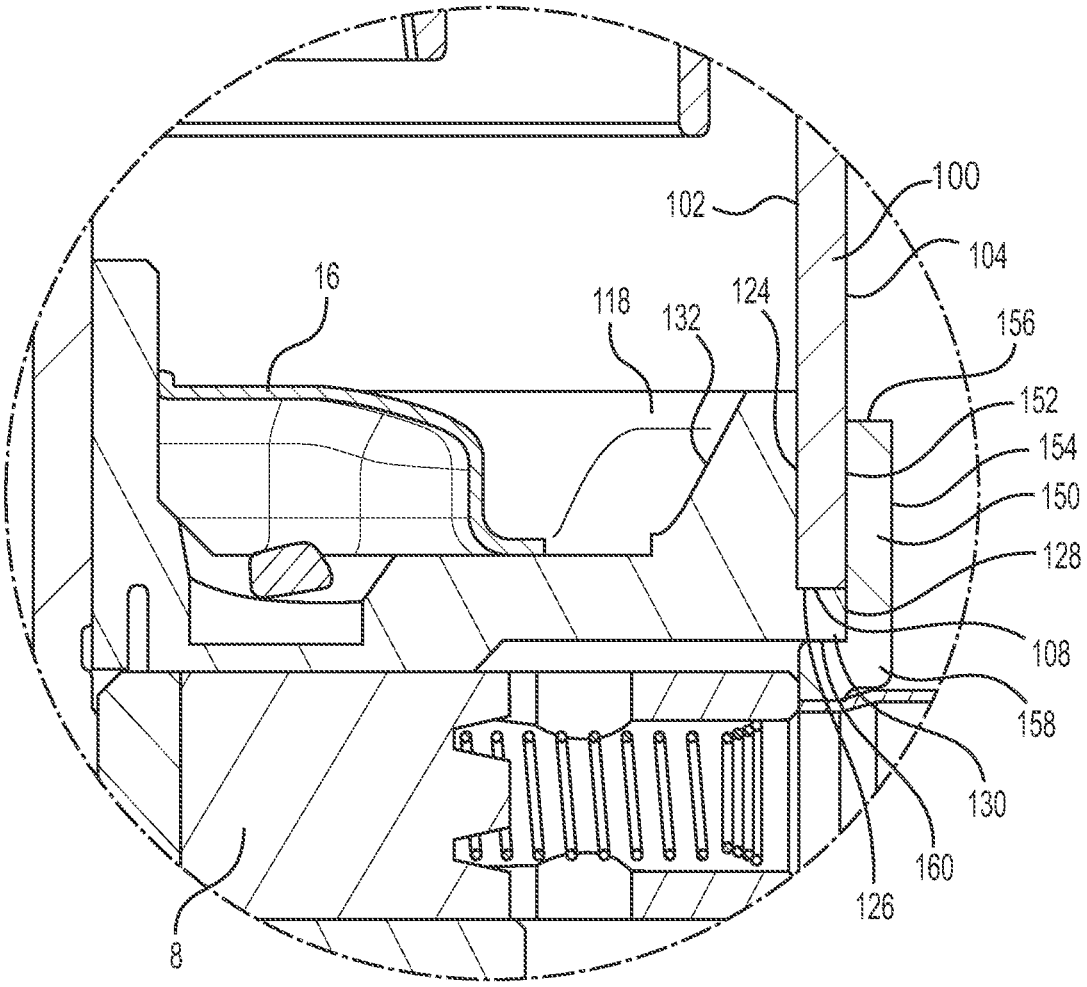
FIG. 7 illustrates an enlarged cross-sectional view of a portion of the cross-sectional view of the rotary compressor of FIG. 1 according to some implementations.

FIG. 7 illustrates an enlarged cross-sectional view of a portion of the cross-sectional view of the twin rotary compressor of FIG. 1 according to some implementations. As explained in more detail below, the lower cap 150, the main bearing frame 110, and the center shell 100 are press fit to achieve and maintain bearing alignment on the main shaft 22. Lower cap 150 has a shoulder or stepped portion 158 that may be above the one or more compression units (e.g., rotary chamber 8) in the axial direction. At the shoulder portion 158 the end or rim edge portion of the lower cap 150 is displaced outward in the radial direction with respect to the portions of the lower cap 150 below the shoulder 158

A top edge 156 of the end or rim may be a flat surface and may be smooth and is even across the lower cap 150. Further, the top edge 156 may be perpendicular to the main axis 24. Along an inner surface 152 of the lower cap 150, a top facing surface 160 that may be perpendicular to the main axis 24 faces and abuts a portion of the stepped lower surface 130 of the main bearing frame 110. The ends or rim edges of the lower cap (i.e., 156) may extend upwards in the axial direction to overlap the center shell 100 as desired for various weld points between the lower cap 150 and the center shell 100. Additionally, upon assembly, the lower end 108 of the center shell 100 contacts and abuts the top facing surface 126 of bearing frame 110.

Further, the inner surface 152 of the lower cap 150 and the outer surface of the lower cap 154 extends upward in the axial direction from the stepped or shoulder portion 158 and may be perpendicular to the top facing surface 160. Accordingly, as shown, the outer vertical edge 128 of the main bearing frame 110 abuts and contacts a portion of the inner surface 152 of the lower cap 150 above the stepped portion 158 in the axial direction. Further, the inner surface 152 contacts and abuts the outer surface 104 of the center shell 100. There may be a clearance between these two contacts and they may slip fit with respect to one another. In addition, bearing alignment may not dependent on these surfaces. As further shown in FIG. 7, a portion of the inner surface 102 contacts and abuts the inward vertical edge 124 of the main bearing frame 110. Additionally, there may more clearance in the axial direction than what is shown in FIG. 7 between the stepped portion 158 and the suction fitting of the compression unit that is partially shown.

FIG. 8 illustrates a cross-sectional view of a rotary compressor according to some implementations that have a single compression unit. As mentioned above, number of compressor cylinders or units (e.g., single or twin) is not a limitation. FIG. 8 shows an implementation including a single compression unit (shown by at least elements 208, 202). Other elements or portions of the compressor shown may be omitted since they are the same or similar.

A difference between the implementation shown in FIG. 1 and FIG. 8 is that the compressor of FIG. 8 includes elements that are press fit such as a upper cap 260, center shell 300, lower cap 350, and a main bearing frame 310, for example, but does not include an upper bearing plate. Accordingly, upon assembly, the upper cap 260 is press fit onto the center shell 300. In particular, a top end 306 of the center shell 300 contacts and abuts an inner downward facing surface 268 of the upper cap 260. Similar to the above description, the inner downward facing surface 268 is essentially flat and may be perpendicular to the main axis 224. Further, a portion of an outer surface 304 of the center shell 300 may contact or abut a portion of the inner surface 262 of the upper cap 260. In some implementations, a clearance or gap may be provided. Additionally, as shown, the upper cap 260 has a stepped or shoulder portion 263 extending in the radial direction forming a horizontal surface 264 upon which a force may applied to press fit the components. Further, although a clearance may be shown between the upper cap 260 and center shell 100, the clearance may vary or there may not be a clearance.

The implementation of the compressor 200 of FIG. 8 further includes a main bearing shaft 222, a lower bearing plate 370 holding a lower bearing, an upper discharge muffler 216, and one or more fasteners 220. Further, a hermetic terminal 206 is provided for connection with the motor components, which include a rotor 236 and a stator 238, a discharge fitting 204 is disposed in the upper cap, although, the location of the discharge fitting 204 is not limited to what is shown. Further, a main bearing 250 supports the main shaft 222 and is disposed within the main bearing frame 310.

With respect to the interface of the main bearing frame 310, center shell 300, and the lower cap 350, the interaction and contact surfaces may be the same or similar as described above. Further, the physical structure (shape) and physical relationships of the components may be the same as described above.

Figure 9:
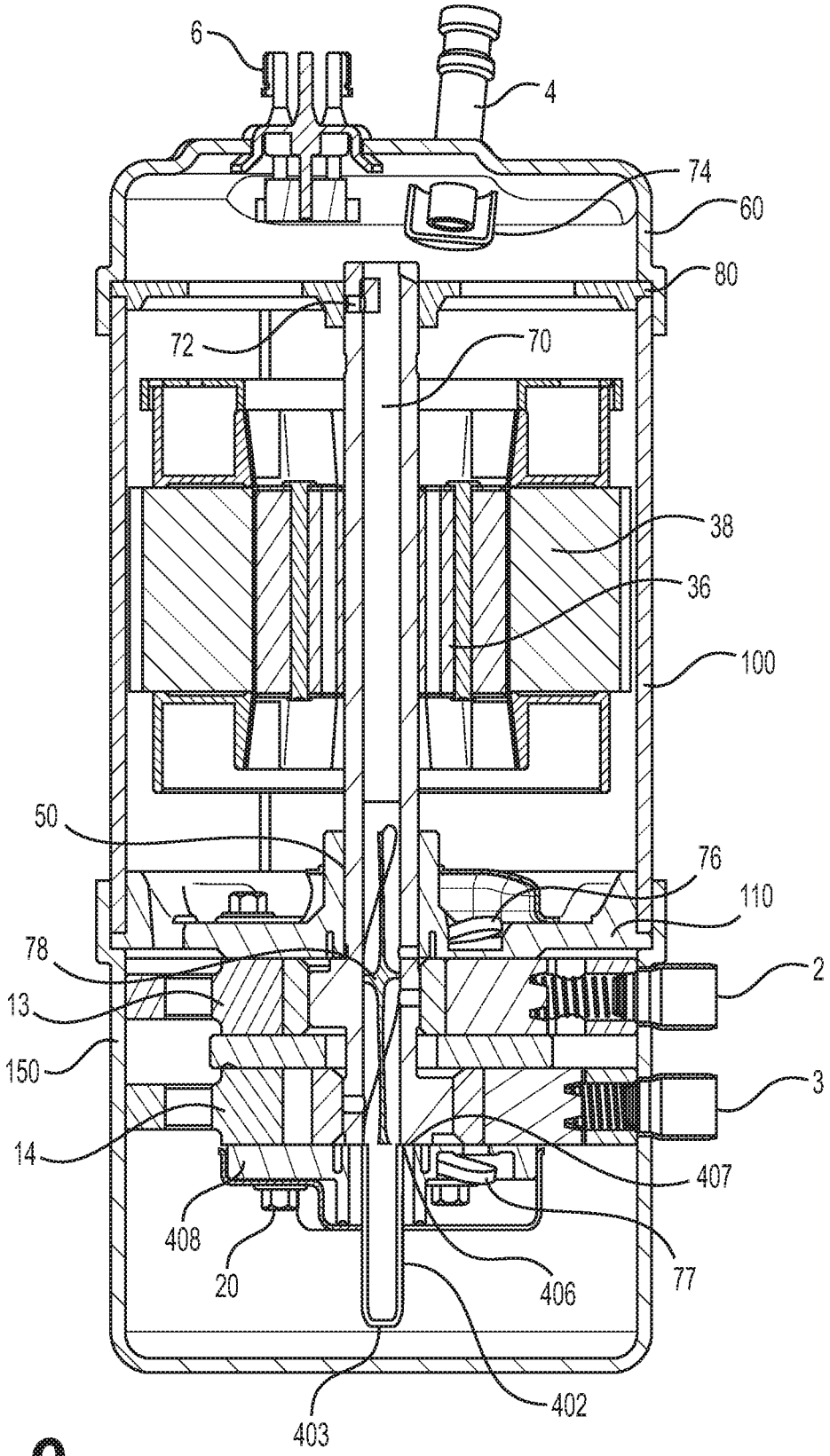
FIG. 9 illustrates a cross-sectional view of a rotary compressor according to some implementations.

FIG. 9 is a cross-sectional view of a rotary compressor according to some implementations. FIG. 9 shows an implementation in which a lower bearing, lower bearing assembly and lower bearing plate and associated components are not included. Other elements not discussed are the same or as similar as discussed above. Further, FIG. 9 shows two compression units, however, the implementation shown in FIG. 9 and associated description may be applied to implementations in which a single compression unit is included, such as the compressor shown and described with respect to FIG. 8. In the implementation shown in FIG. 9, a compressor that does not include a lower bearing and lower bearing plate includes a main bearing 50 and a main bearing frame 110 and may include an upper bearing 32 and upper bearing plate 80 that is above the motor components in the axial direction as shown and described with respect to FIG. 1. FIG. 9 also shows an upper cap 60, center shell 100, and lower cap 150. In the implementation shown in FIG. 9, the compression load can adequately be handled by the main bearing 50 and the upper bearing 32 and therefore, the lower bearing and assembly are not necessary.

FIG. 9 shows a lower plate 408 that is disposed below the compression unit(s) 3, 2 in the axial direction. As shown, the main shaft 22 may not extend below the compression unit components. Lower plate 408 has an opening or passage to allow an oil pick up tube 402, having an opening 403 to allow oil to be suctioned into the tube 402. The oil tube 402 may rotate with the main shaft 22 and may be press fit into the lower end of the shaft. The lower plate 408 is fastened, using bolts or the like, to the compression assembly.

Further, the lower end of the main shaft 22 rests on a thrust washer 406 with a center hole for tube 402 clearance. The thrust washer 406 is held in place by the lower plate 408. Further, the shaft thrust surface 407 is essentially disposed at the emergence of the oil pickup tube 402 from the main shaft. Further, an upper discharge valve 76 and a lower discharge valve 77 is shown. Oil may be pumped upward through the passage in the main shaft 70 through centrifugal force from the opening 403 in the oil pick up tube 402. Additionally, in some implementations, an oil paddle or propeller 78 may be disposed on the main shaft and an oil baffle 74 may be disposed near the discharge fitting 4 to restrain oil from being discharged.

The following describes various assembly or manufacturing steps and techniques of the rotary assembly implementations disclosed herein. The steps and techniques described are not limited to the order in which they are disclosed and not every step is required in every implementation. Additionally, there may be additional steps or techniques used that are not specifically discussed. Further, the steps may apply to any implementation described herein and not just specifically referred to below.

Conventional methods use some type of C-frame assembly mechanism to hold the key components in alignment, while a housing with ample clearance is inserted over the assembly. The housing has holes which align with key components, then welding procedures secure these parts together, through the holes. Alignment depends on the assembly mechanism and the housing is joined to the aligned parts, then the mechanism is released. However, when using this machine, alignment of the machine and alignment of the main shaft and bearing assemblies is very critical and there must be a clearance between the center shell and inner parts and welding is done through holes in the center shell. Using the C-frame machine, for example, the welding through the holes is necessary since alignment of the bearings needs to be fixed or secured in this way. In some implementations, the present invention press fits elements of the compressor and the elements, especially the bearings, self-align as a result of the physical structure of the various parts, as described herein. In these implementations, welding through holes in the center shell similar to the above is not required to maintain alignment of the bearings.

The main bearing 50 and press fit alignment and securing method includes machining the main bearing frame 110 and boring the main bearing 50 so that the main bearing 50 is concentric to the inward vertical edge 124 and perpendicular to the top facing surface 126. After machining the edges and surfaces (e.g., one or more of 122, 124, 112, 128, 136, 130, 120) the main bearing frame 110 may be pre-assembled with the compression units or mechanisms. The stator 38 may be previously pressed into place by induction heating the center shell 100. The main bearing frame 110 may be placed into lower cap 150 so that a portion of bottom surface 130 contacts surface 160.

The center shell 100 is aligned over the main bearing frame 110, such that the inner surface 102 of the center shell is pressed over the inward vertical edge 124 of the main bearing frame 110 and the outer surface 104 is pressed over the inner surface 152 of the lower cap 150 and therefore the lower end 108 of the center shell 100 is pressed into a slot or gap formed by the inner surface 152 and the outer vertical edge 124. This step ensures that the main bearing of the main frame is concentric with the main axis 24. The press component movement stops when the lower end 108 of the center shell 100 is in contact with the top facing surface 126.

Further, the center shell 100 assembly could be previously pressed onto the main bearing frame 110 and compression package sub-assembly (e.g., the compression units, main bearing frame 110, main shaft 22, lower plate 150). This sub-assembly may then be placed into the lower cap sub-assembly (e.g., lower cap 150, mounting feet, suction fittings welded into the cap), and then the entire assembly is pressed together and then tack welded.

In some implementations, the lower cap 150 could first be positioned in a fixture, similar to a bowl, where the fixture support is under the flat downward facing surface of the outer surface 154 of the stepped portion 158. The main bearing frame 110 and compression package sub-assembly may then be positioned into the lower cap, to the point where a portion of bottom facing surface 130 of the main bearing frame 110 rests on surface 160 of the lower cap 150. The case sub-assembly could then be positioned and pressed onto the aforementioned gap of the inward vertical edge 124 and inner surface 152 of the center shell 100. The inside surface 152 of the of the lower cap 150 would be a slip fit over the outer surface 104 of the center shell 100. The entire assembly is then pressed together, and tack welded, and moved to final processing.

With either alternative, the load is aligned with the reaction point, such that any force moment through the assembly is minimized to avoid distortion. The small tack welds essentially freeze the alignment as well as the preload applied during the pressing operation.

Subsequently, the upper cap 60 is press fit onto the previous assembly, with a load applied on the horizontal surface 64 of the shoulder portion 63 of upper cap 60. The outer vertical edge 85 and the outer surface 104 of the center shell 100 are a slip fit with the inside surface 62 of the upper cap 60.

The load may be aligned with the reaction point, on the upper face of the case; such that any force moment through the assembly is minimized to avoid distortion. While the assembly is held together under force, several small tack welds may be applied; and these essentially freeze the alignment as well as the preload applied during the pressing operation. The upper cap and lower cap are then spot welded using Tungsten Inert Gas (TIG) and the seams are Metal Inert Gas (MIG) welded.

Figure 10:
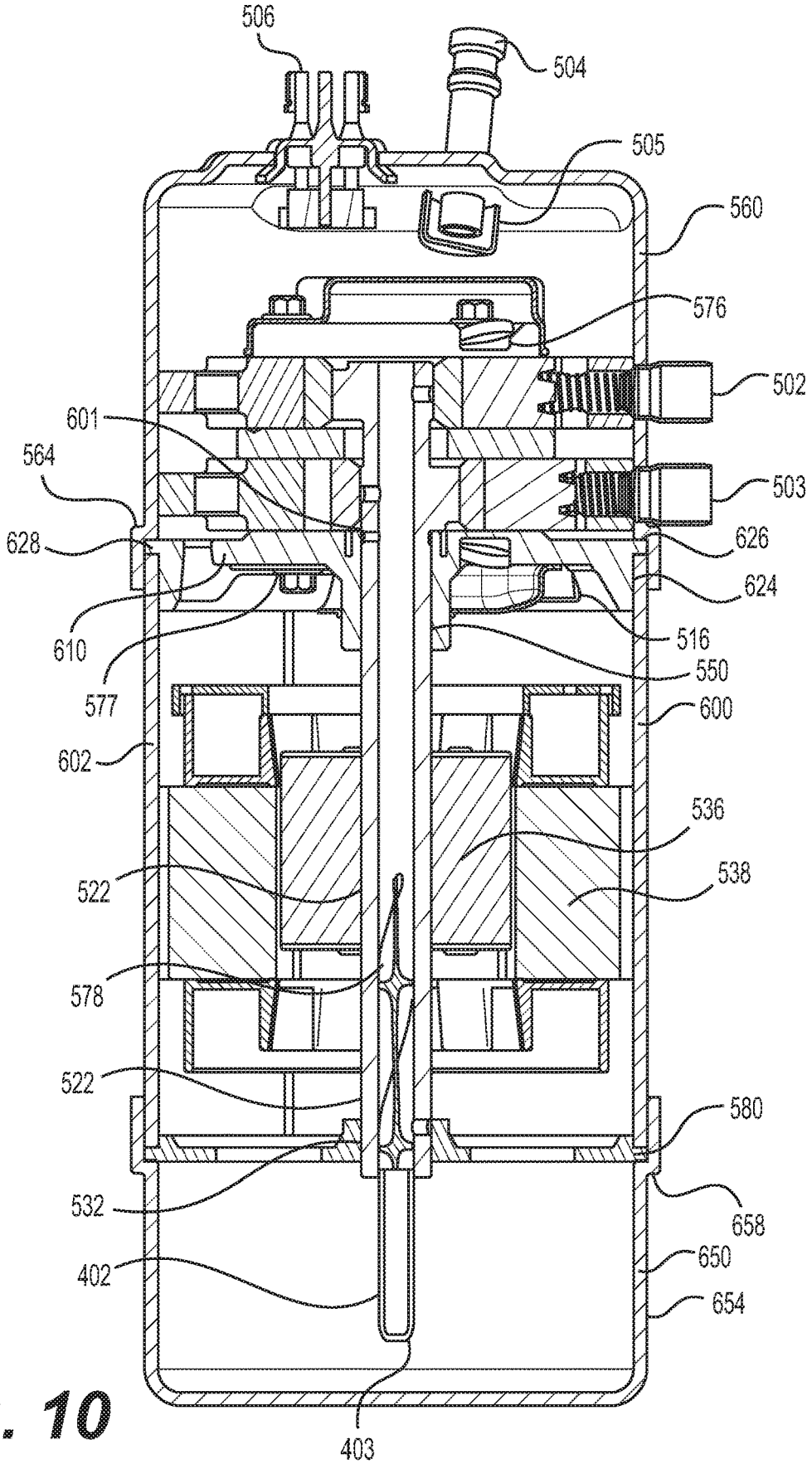
FIG. 10 illustrates a cross-sectional view of a rotary compressor according to some implementations.

FIG. 10 shows a cross-sectional view of a rotary compressor according to some implementations. FIG. 10 shows an implementation including an upper cap 560, center shell 600, and lower cap 650 as housing elements. In this implementation, the same or similar techniques as described above apply and the upper bearing 32 and upper bearing plate 80 are similar to the lower bearing 532 and lower bearing plate 580, respectively, and the main bearing 50 and main bearing frame 110 are similar to the main bearing 550 and main bearing frame 610, respectively. However, as shown the respective orientations of the lower bearing plate 580 and the main bearing frame 610 are upside down or reversed with respect to the descriptions and implementations described above. As shown, the main bearing frame 610 is in the top part of the compressor and is opposite the motor components from the lower bearing plate 580. The alignment and securing of the main bearing frame 610 and the lower bearing plate 580 are the same or similar as discussed above with respect to other implementations. In other words, the components are machined as described above and press fit to achieve bearing alignment.

The implementation shown in FIG. 10 further shows a hermetic terminal 506, discharge fitting 504, upper suction port or fitting 502 for an upper compression unit, lower suction port or fitting 503 for a lower compression unit, motor rotor 536, and motor stator 538, which are similar to the elements described above.

As described above, an oil pick up tube 402, having an opening 403, is pressed into the lower end of the main shaft 522. An oil baffle 505 may also be provided as shown in FIG. 10. FIG. 10 further shows the shaft thrust surface 601, which is discussed with respect to other implementations above. However, this could be disposed on the end of the shaft 522 and the lower bearing plate 580. Further shown is an upper discharge valve 576, and lower discharge valve 577, motor rotor 536, motor stator 538, The following steps describe the assembly of the implementation shown in FIG. 10. The order of the steps is not limiting and there may be additional steps not specifically disclosed.

The lower cap 650 could first be positioned in a fixture, similar to a bowl, where the fixture support is under the flat downward facing surface of the outer surface 654 of the stepped portion 658. The lower bearing plate 580 may then be positioned into the lower cap 650, to the point where it rests on the step 658 inside the lower cap 650.

The center shell 600 sub-assembly (including the stator) may then be positioned and pressed onto the lower bearing plate 580. Similar to the description of the assembly explained above, the inside surface of the lower cap 650 would be a slip fit over the outer surface of the case 600. The assembly may then would be pressed together and tack welded.

An entire compression mechanism could be sub-assembled offline, and this includes: shaft 522, main frame, rollers, cylinders 13, 15, vanes 8, 9, sub and top plate, along with the discharge valves. In the alternative, only the main shaft 522, main frame, and possibly the lower roller, vane 8, 9, and cylinder 13, 15 are sub-assembled.

Subsequently, the rotor 528 is induction heated, and the shaft/frame sub-assembly is inserted into the bore of the rotor 528. The sub-assembly is then lowered into the center shell 600, and the end of the shaft 522 is inserted into the lower bearing 532 bore. After insertion into the bearing, the assembly steps are similar to those described above but in reverse and are note repeated here. The outer vertical edge 628 of the main bearing frame 610 is press fit into the inside surface of the center shell 602 until outer vertical edge 628 is uniformly in contact with the end surface of the center shell 600.

The upper cap 560 is then aligned radially, then the press tooling must contact on the upper cap 560 surface 564, and press downward to make contact with a portion of a top surface 626 of the main bearing frame 610. The remaining final steps are similar to what has been described above.

Figure 11:
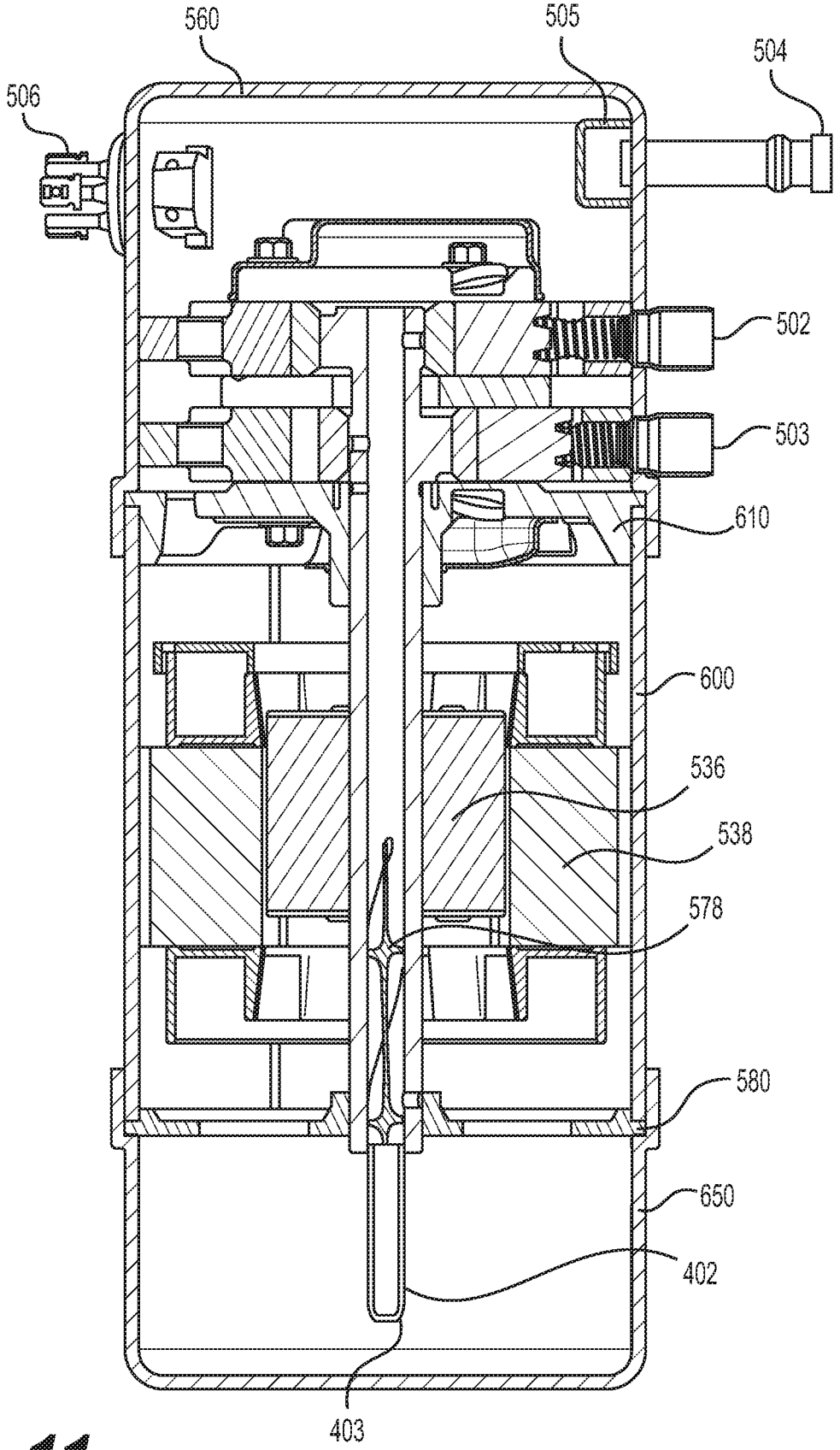
FIG. 11 illustrates a cross-sectional view of a rotary compressor according to some implementations.

Further, with respect to the discharge fitting 504 and hermetic terminals 506, either or both of the hermetic terminal and the discharge fitting may be disposed on a side of the upper cap 560, which can offer advantages for connections to different system designs and for shipping. FIG. 11 illustrates a cross-sectional view of a rotary compressor according to some implementations. Some elements shown in FIG. 11 may be the same or similar to the elements described above and may not be repeated here. FIG. 11 shows a main bearing frame 610, upper 502 and lower 503 suction fittings for each compression unit, upper cap 560, center shell 600, lower cap 650, and lower bearing plate 580, motor rotor 536, motor stator 538, oil pickup tube 402 having an opening 403. In some implementations an oil paddle 578 may be included in the main shaft. Oil may be pumped by centrifugal force through operation of the main shaft and picked up by the oil pick up tube 402.

In the rotary compressor shown in FIG. 11 the hermetic terminal 506 is shown disposed on a portion of a side of the upper cap 560 positioned horizontally. Further, a discharge fitting 504 is disposed on another portion of the side of the upper cap 560. The discharge fitting 504 is also disposed horizontally, instead of vertically as shown in other figures. An oil baffle 505 may also be included to restrain oil.

Figure 12:
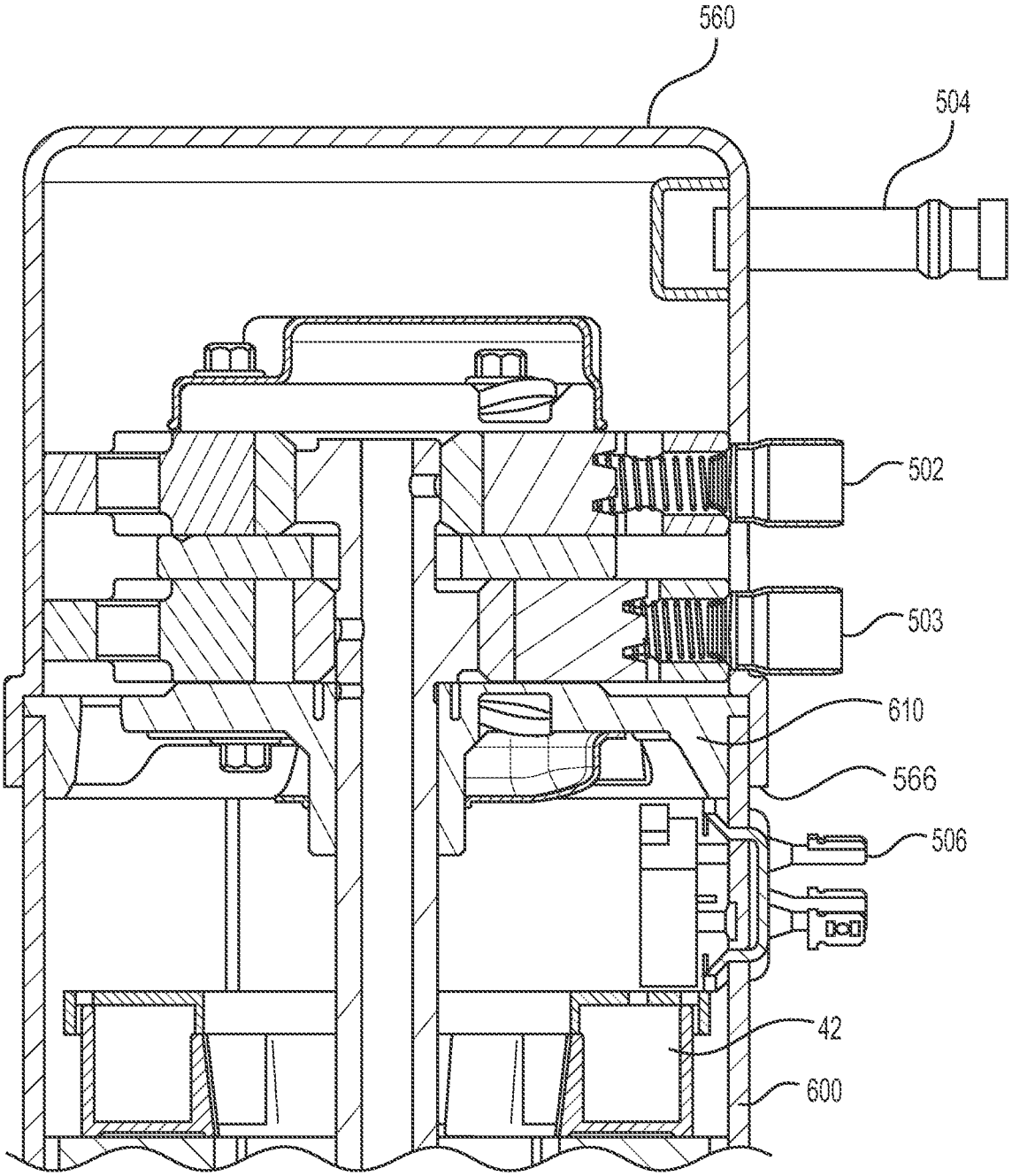
FIG. 12 illustrates a portion of a cross-sectional view of a rotary compressor according to some implementations.

FIG. 12 illustrates a portion of a cross-sectional view of a rotary compressor according to some implementations. Some elements shown in FIG. 12 may be the same or similar to the elements described above and may not be repeated here. FIG. 12 shows, for example, upper cap 560, upper 502 and lower 503 suction fittings for each compression unit, a main bearing frame 610, and a center shell 600 among other elements not specifically listed here. As shown, in some implementations of a rotary compressor, a hermetic terminal 506 may be disposed on the side of a center shell 600 and the terminals are protrude horizontally. The hermetic terminal 506 may be disposed below the interface or overlap of the upper cap 560 and the center shell 600 and may be disposed below the main bearing and main bearing frame 610 in the axial direction, as shown. Further, the hermetic terminal may be disposed above the windings 42 in the axial direction, as shown. Additionally, there may be a greater clearance or distance in the axial direction between the hermetic terminal 506 and the end surface 566 of the upper cap 560 than what is shown so that, for example, a weld may be placed at the seam of the upper cap 560 and the center shell 600.

In addition, disposing the discharge fitting 4 in a horizontal position on a side of the upper cap 60 provides horizontal discharge of the fluid which has advantages for oil separation and minimizing oil circulation rate. Further, disposing the hermetic terminal 6 in a side of the center shell 100 makes the assembly process easier and if the hermetic terminal 6 is disposed on the side of the center shell 100, it may be connected to the stator lead block.

According to the implementations described above, a rotary compressor includes an upper cap 60, a center shell 100, and a lower cap 150. A rotary compressor may include two or more compression units. In this case, as shown and described with respect to FIG. 1, the compressor includes a main bearing 50, a main bearing frame 110, an upper bearing 32, and an upper bearing plate 80. In this case, the lower bearing 44 and lower bearing plate 170 may or may not be included as implemented, configured and assembled as described above.

Further, a rotary compressor may comprise a single rotary compression unit. In this case, the rotary compressor may include an upper cap 60, a center shell 100, and a lower cap 150. Further, the rotary compressor may comprise a main bearing 50, a main bearing frame 110, an upper bearing 32, and an upper bearing plate 80. In this case, the lower bearing and lower bearing plate may or may not be included as implemented, configured and assembled as described above. In some implementations of the rotary compressor having a single rotary compression unit, the rotary compressor may include the main bearing, main bearing frame, the lower bearing, and the lower bearing plate and not include the upper bearing and upper bearing frame as implemented, configured and assembled as described above.

Figure 13:
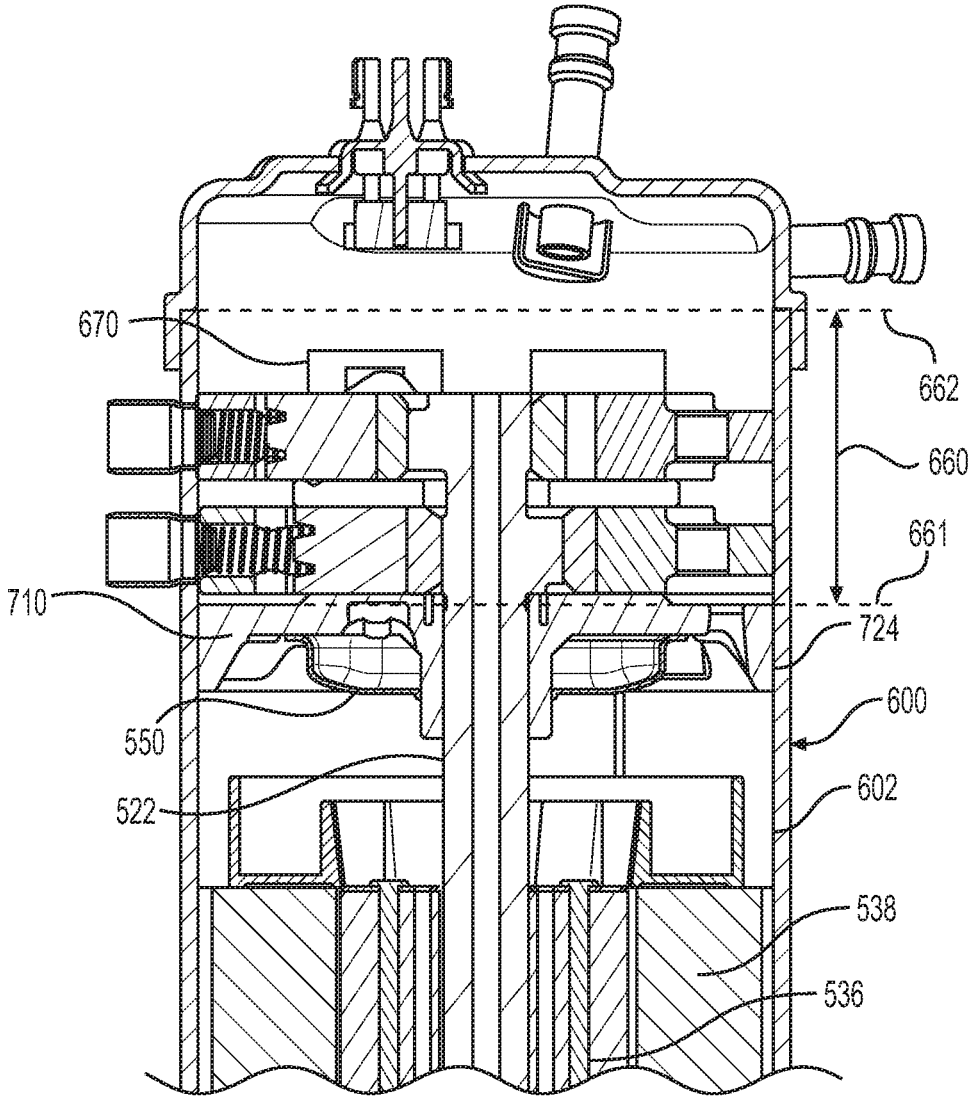
FIG. 13 illustrates a portion of a cross-sectional view of a rotary compressor according to some implementations.

FIG. 13 shows a portion of a cross-sectional view of a rotary compressor according to some implementations. Some elements shown in the rotary compressor of FIG. 13 are the same or similar to those shown in FIG. 10 and therefore will not be repeated here.

According to some implementation as shown in FIG. 13, the main bearing frame 710 does not contact the upper cap 560 and may not include the outer vertical edge 628 which protrudes outward in the radial direction. Rather, the vertical edge 724 is the outer most edge in the radial direction around the main bearing frame 710. In this instance, the vertical edge 724 may contact the inner surface 602 of the center shell and the inner surface 602 slides against the main bearing frame 610 during assembly. The main bearing frame 610 in this instance is disposed lower than the interface of the upper cap 560 and the center shell 600. Accordingly, the upper cap 560 and the center shell 600 abut and contact each other as described above with respect to FIG. 8. In other words, the inner surface of the shoulder portion of the upper cap 560 abuts and contacts the top end portion of the center shell 600 and the outer surface of the center shell 600 slide fits against the inner surface of the upper cap 560 that is below the shoulder portion of the upper cap 560 in the axial direction.

Another difference between the implementation of FIG. 13 and previously described implementations is that the press fit has been based on forces below the yield point on the stress-strain curve of low carbon steel of the respective components, such as the upper cap 60, center shell 100, and lower cap components 150.

In the implementation of FIG. 13 press fit technology is employed that actually yields the stretched center case 100 material beyond its plastic yield point. This means permanent deformation. For this condition to be present, the outside diameter (e.g., vertical edge 724) of the main bearing frame 710 must be continuous; without interruptions.

In addition, the outside diameter (e.g., vertical edge 724) of the main bearing frame 710 must be greater than the inner surface 602 of the center shell 100, and may also have a tapered section on the lower plane of the outside diameter (e.g., vertical edge 724). Accordingly, the main bearing frame 710 is manufactured and press fit into place inside the center shell 100. This implementation has an advantage such that this enables freedom to locate a key component between the ends of the center shell 100 and not on one end of the center shell 100.

The following is an example of the assembly steps for the implementation described and shown in FIG. 13. The center shell 100 must be machined such that each open end is parallel, and these are perpendicular to the centerline axis 24. The stator 538 is inserted into the case by induction heating the center shell 100. Insert the shaft 522 into the main bearing frame 710, from the top (because the eccentric sections prevent the alternative). The main frame is completely assembled with its discharge valve, cover, etc.

Steps further include, induction heat the rotor 536 and insert the main frame/shaft sub-assembly down, such that the shaft passes through the rotor 536 to its final position, before it cools. Set the upright center shell 100/stator 538 sub-assembly into a centerline lower plate locator in a vertical press of adequate alignment and force potential. The upper press plate moves up and down, and is completely parallel with the lower plate of the press. Then, insert the main frame/shaft/rotor sub-assembly into the top of the case/stator sub-assembly, to the point where the rotor 536 passes inside the stator 538 and the assembly stops when the main frame 710 tapered section engages into the inner surface of the case 602. Some rotor/stator spacing assistance is required, if the rotor 538 contains permanent magnets. At this point, the main frame 710 diameter is too large to drop any further.

Then, the aligned press is engaged, with the flat plate moving downward. The flat plate is perpendicular to the centerline of the compressor case in its position. The upper plate 670 is designed such that an extended section, which moves inside the center shell 100 during the operation, is the design distance 660 from the top edge of the case 662 to the point where the main frame is inserted 661.

When the plate reaches the upper edge of the main frame sub-assembly, the tapered edge begins to insert into the center shell 100. The force rises dramatically as the press forces the diameter of the main frame to enlarge the inner surface 602 of the center shell 600, just beyond the material yield point.

The press operation ends when the upper plate 670 makes full contact with the top edge of the center shell 100. Assuming all press and component accuracy meetings requirement, the main frame is now located at the frame alignment plane.

This entire sub-assembly could then be placed over the lower cap, which may have a lower bearing plate in place. For example, a lower bearing plate and lower cap may apply to this implementation. The shaft 522 must be engaged into the lower bearing bore, and then the assembly can be pressed together, tac welded as described in previous alternatives.

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed:

1. A rotary compressor, comprising:

a housing, including a first cap, a second cap, and a center shell, the first cap disposed opposite the center shell from the second cap in an axial direction;

a main shaft extending along a main axis;

two rotary compression units each having a suction port and a cylinder to compress fluid;

a motor including a rotor and a stator;

an outboard bearing supporting the main shaft;

a main bearing supporting the main shaft;

an outboard bearing plate housing the outboard bearing that is disposed opposite the motor from the main bearing in an axial direction;

a main bearing frame housing the main bearing disposed between the two rotary compression units and the motor in the axial direction, wherein the center shell is essentially cylindrical and a first edge surface and a second edge surface of the center shell are parallel to one another, and perpendicular to the main axis, and wherein the first edge surface of the center shell contacts a first surface of the outboard bearing plate that is perpendicular to the main axis of the rotary compressor.

2. The rotary compressor of claim 1, wherein a first portion of the center shell contacts an outer peripheral second surface of the outboard bearing plate of a first predetermined diameter, which is perpendicular to the first surface and concentric with a bearing bore of the outboard bearing plate that houses the outboard bearing.

3. The rotary compressor of claim 1, wherein the second edge surface of the center shell contacts a first surface of the main bearing frame that is perpendicular to the main axis, and wherein a second portion of the center shell contacts an outer peripheral second surface of the main bearing frame of a second predetermined diameter, which is perpendicular to the first surface of the main bearing frame and concentric with a bearing bore of the main bearing frame that houses the main bearing.

4. The rotary compressor of claim 1, wherein the outboard bearing plate has an outer peripheral third surface of a third predetermined diameter that contacts a portion of an inner surface of the first cap, wherein the outer peripheral third surface is perpendicular to the first surface of the outboard bearing plate and is concentric with a bearing bore of the outboard bearing plate.

5. The rotary compressor of claim 1, wherein the main bearing frame has an outer peripheral third surface of a fourth predetermined diameter that contacts a portion of an inner surface of the second cap, wherein the outer peripheral third surface is perpendicular to a first surface of the main bearing frame and is concentric with a bearing bore of the main bearing frame.

6. The rotary compressor of claim 1, wherein a third predetermined diameter of the outboard bearing plate is greater than a first predetermined diameter, and wherein a fourth predetermined diameter of the main bearing frame is greater than a second predetermined diameter.

7. The rotary compressor of claim 1, wherein the first cap has a stepped portion and a first portion of an inner surface of the stepped portion of the first cap is perpendicular to the main axis and contacts a surface of the outboard bearing plate that is opposite first surface of the outboard bearing plate, and wherein a second portion of the inner surface closer to the motor in the axial direction than the stepped portion is concentric with a bearing bore of the outboard bearing plate.

8. The rotary compressor of claim 7, wherein the second portion of the inner surface of the first cap closer to the motor in the axial direction than the stepped portion overlaps and contacts each of an outer peripheral third surface of the outboard bearing plate and a first portion of an outer surface of the center shell.

9. The rotary compressor of claim 1, wherein the second cap has a stepped portion and a first portion of an inner surface of the stepped portion of the second cap is perpendicular to the main axis and contacts a surface of the main bearing frame that is opposite a first surface of the main bearing frame, and wherein a second portion of the inner surface closer to the motor in the axial direction than the stepped portion is concentric with a bearing bore of the main bearing frame.

10. The rotary compressor of claim 9, wherein the second portion of the inner surface of the second cap closer to the motor in the axial direction than the stepped portion contacts each a third surface of the main bearing frame and a second portion of an outer surface of the center shell.

11. The rotary compressor of claim 1, wherein a lower bearing plate is disposed below the two compression units in the axial direction and houses a lower bearing that supports a lower portion of the main shaft.

12. The rotary compressor of claim 1, wherein, in the axial direction, the main bearing frame is disposed above the two rotary compression units, which is disposed below the motor, which is disposed below the outboard bearing plate.

13. The rotary compressor of claim 1, wherein, in the axial direction, the two rotary compression units are disposed above the main bearing frame, which is disposed above the motor, which is disposed above the outboard bearing frame, and wherein the second cap is above the first cap in the axial direction.

14. The rotary compressor of claim 13, wherein a discharge fitting is disposed in a side of the second cap and is oriented perpendicular with respect to the main axis, and wherein a hermetic terminal having at least one lead for connection to the motor is disposed in a side surface of the center shell below the main bearing frame in the axial direction.

15. The rotary compressor of claim 13, wherein a portion of an inner surface of the center shell contacts an outer peripheral surface of the main bearing frame of a predetermined diameter, which is concentric with a bearing bore of the main bearing frame that houses the main bearing, wherein center shell extends beyond the main bearing frame in both directions of the axial direction, and wherein the second cap has a stepped portion and a first portion of an inner surface of the stepped portion is perpendicular to the main axis and contacts the second edge surface of the center shell.

16. The rotary compressor of claim 1, wherein a hermetic terminal having at least one lead for connection to the motor is disposed in a side surface of the second cap and is oriented perpendicular with respect to the main axis.

17. The rotary compressor of claim 1, wherein a discharge fitting is disposed in a side of the second cap and is oriented perpendicular with respect to the main axis.

18. A method of assembly of a rotary compressor, comprising:

providing a cylindrical center shell having a top end and a lower end that are parallel to one another, flat, and perpendicular to a main axis of the rotary compressor;

providing an outboard bearing plate having a first surface that is perpendicular to the main axis of the rotary compressor and an outer peripheral second surface of a first predetermined diameter, which is perpendicular to the first surface and concentric with a bearing bore of the outboard bearing plate;

providing a main bearing frame having a first surface that is flat and perpendicular to the main axis of the rotary compressor and an outer peripheral second surface of the main bearing frame of a second predetermined diameter, which is perpendicular to the first surface and concentric with a bearing bore of the main bearing frame;

placing two rotary compression units each having a suction port and a cylinder to compress fluid, a main shaft, a main bearing, and the main bearing frame into a lower cap;

placing a rotor of a motor onto the main shaft above the two rotary compression units;

pressing the center shell over the main bearing frame such that the lower end of the center shell contacts the first surface of the main bearing frame and a portion of an inner surface of the cylindrical center shell contacts and slides against the second surface of the main bearing frame;

placing the outboard bearing plate onto the shaft and onto the center shell such that the top end of the cylindrical center shell contacts the first surface of the outboard bearing plate and a portion of the inner surface of the cylindrical center shell slides against the second surface of the outboard bearing plate, wherein the outboard bearing plate is disposed above the motor in the axial direction;

pressing the upper cap on to the outboard bearing plate and over a portion of the cylindrical center shell;

holding the upper cap in place; and welding each of the upper cap and the lower cap into place.

* * * * *